United States Patent [19]

Mazzucco

[11] 4,366,367

[45] Dec. 28, 1982

[54] ELECTRIC FABRIC STEAMING APPLIANCE WITH PREVENTION OF WATER REFILL THROUGH THE STEAM DISCHARGE OUTLET

[75] Inventor: Daniel Mazzucco, Annemasse, France

[73] Assignees: Terson Terraillon, Annemasse; Marc Terraillon, Gaillard, both of France

[21] Appl. No.: 94,659

[22] Filed: Nov. 15, 1979

[30] Foreign Application Priority Data

Dec. 21, 1978 [CH] Switzerland ..... 13029/78

[51] Int. Cl.[3] ..... H05B 3/00; D06F 75/16

[52] U.S. Cl. ..... 219/272; 38/69; 38/77.4; 38/77.82; 38/77.9; 68/222; 219/245; 219/275; 219/295; 222/147; 239/136

[58] Field of Search ..... 38/77.1–77.9, 38/91, 92, 69; 68/222; 219/271–276, 284–295, 437, 245; 222/147; 239/136

[56] References Cited

U.S. PATENT DOCUMENTS

| | | | |
|---|---|---|---|
| 1,603,425 | 10/1926 | Steere | 219/437 |
| 1,782,069 | 11/1930 | Hennings | 219/289 |
| 1,797,457 | 3/1931 | Weiss | 219/295 |
| 1,806,729 | 5/1931 | Aitken | 219/273 |
| 1,830,875 | 11/1931 | Izumiya | 38/77.2 |
| 1,927,316 | 9/1933 | Katzman . | |
| 2,076,709 | 4/1937 | Deutsch | 219/271 X |
| 2,152,122 | 3/1939 | Wilcox | 219/288 X |
| 2,323,225 | 6/1943 | Ledbetter | 38/77.8 |
| 2,384,644 | 9/1945 | Schreyer | 38/89 |
| 2,385,865 | 10/1945 | Kollmeyer | 68/222 |
| 2,777,225 | 1/1957 | Cone | 38/77.4 |
| 2,849,736 | 9/1958 | Kohle | 68/222 |
| 3,579,262 | 5/1971 | Peeps | 219/295 |
| 3,646,317 | 2/1972 | Osrow | 219/271 |
| 3,755,649 | 8/1973 | Osrow | 219/275 X |
| 3,805,425 | 4/1974 | Spoida et al. | 68/222 X |
| 3,969,607 | 7/1976 | Osrow et al. | 38/77.4 X |
| 3,997,759 | 12/1976 | Osrow et al. | 219/295 X |

FOREIGN PATENT DOCUMENTS

| | | | |
|---|---|---|---|
| 573813 | 4/1933 | Fed. Rep. of Germany . | |
| 730065 | 5/1932 | France | 219/284 |
| 1017946 | 10/1952 | France . | |
| 2024201 | 8/1970 | France . | |
| 1315083 | 4/1973 | United Kingdom | 38/69 |
| 1338108 | 11/1973 | United Kingdom . | |

*Primary Examiner*—A. Bartis

*Attorney, Agent, or Firm*—Pennie & Edmonds

[57] ABSTRACT

An appliance for removing creases is disclosed having a handle (1) and a body (2) comprising a tank (3) partially filled with water (4) heated by an electrical heating and vaporized element (5) connected to contact prongs (7). The vapor so produced flows through a duct (9) to orifices (11) in a plate (10) adapted to be slid over the surface from which creases are to be removed. The tank (3) is filled through opening (16) which is partially closed by an inwardly extending retainer flange (18) which is located between a stopper (20) for the filling opening (16) and a retaining finger (19). At its other end, the handle (1) has an opening (22) therein in alignment with a socket (8) which receives a removable plug (30) of a supply cord. When the plug (30) is in place (FIG. 1), it is impossible to turn the handle. Upon removal of the plug (30), the handle (1) may be pivoted about the axis of the opening (16) (FIG. 2) until the finger (19) passes the edge (29) of the retainer flange (18), thus permitting removal of the handle (1) and filling of the tank (3). Any attempt to fill the appliance through the steam orifices (11) is prevented by a ball (13) freely movable in the duct under gravity (FIG. 1) which, when the appliance is turned over, blocks the duct (9).

5 Claims, 2 Drawing Figures

ELECTRIC FABRIC STEAMING APPLIANCE WITH PREVENTION OF WATER REFILL THROUGH THE STEAM DISCHARGE OUTLET

BACKGROUND

1. Field of the Invention

The present invention relates to an appliance for removing creases from fabrics.

2. Prior Art

In conventional appliances of this type, there is generally provided a body with a handle fixed to the body in order to enable the operator to pass the appliance over the fabrics to be pressed. The body forms a water tank, the water of which is heated by means of electric current passing through an electrical heating element. The water is introduced into the tank by means of a suitable opening formed in the body of the appliance.

The body has a working surface which is equipped with small openings which enable diffusion of the steam from the heated water through the openings and onto the material being pressed. Often the working surface may include a transverse brush whereby the combined action of the diffused steam and the brush will remove the creases from the fabric.

One disadvantage of these appliances is that they can become dangerous to humans. For example, the user may simply fill the appliance with water through the opening formed for this purpose while the appliance remains connected to the electric current. Under such circumstances, the user is risking shock or even electrocution at the time of filling.

BRIEF SUMMARY OF THE INVENTION

The present invention proposes through an adequate safety device to eliminate this disadvantage by preventing filling of the appliance when it is connected to the electrical current. To that end, an appliance for removing the creases from fabric is provided comprising a body forming a water tank and equipped with a handle, a transverse brush, means for electrically heating the water in the tank, and orifices for the outlet of the steam to be produced and projected against the fabric to be uncreased. The handle is detachable from the body and has at one end a stopper for closing the opening through which the water tank is filled. At its other end, the handle has an opening through which the female plug of an electric cord may be inserted. In the body in alignment with this opening in the handle is a socket having the two prongs which are received into the electrical plug of the cord. These prongs are connected to the heating element in the water tank.

In order to remove the stopper from the filling opening, it is necessary first to remove the plug of the electrical cord from the appliance. Then the handle may be pivoted about the axis of the stopper in the filling opening to a point where it can be removed entirely from the appliance. Only in this way is it possible to fill the water tank.

A further safety feature is incorporated in the appliance of this invention in that if the user attempts to fill the water tank through the steam diffusion orifices, the user is prevented from doing so by a ball-type check valve. Thus, the only way water can be introduced into the water tank is to disconnect the same from the electric current and remove the handle.

DETAILED DESCRIPTION OF THE PREFERRED EMBODIMENT

Figure 1:
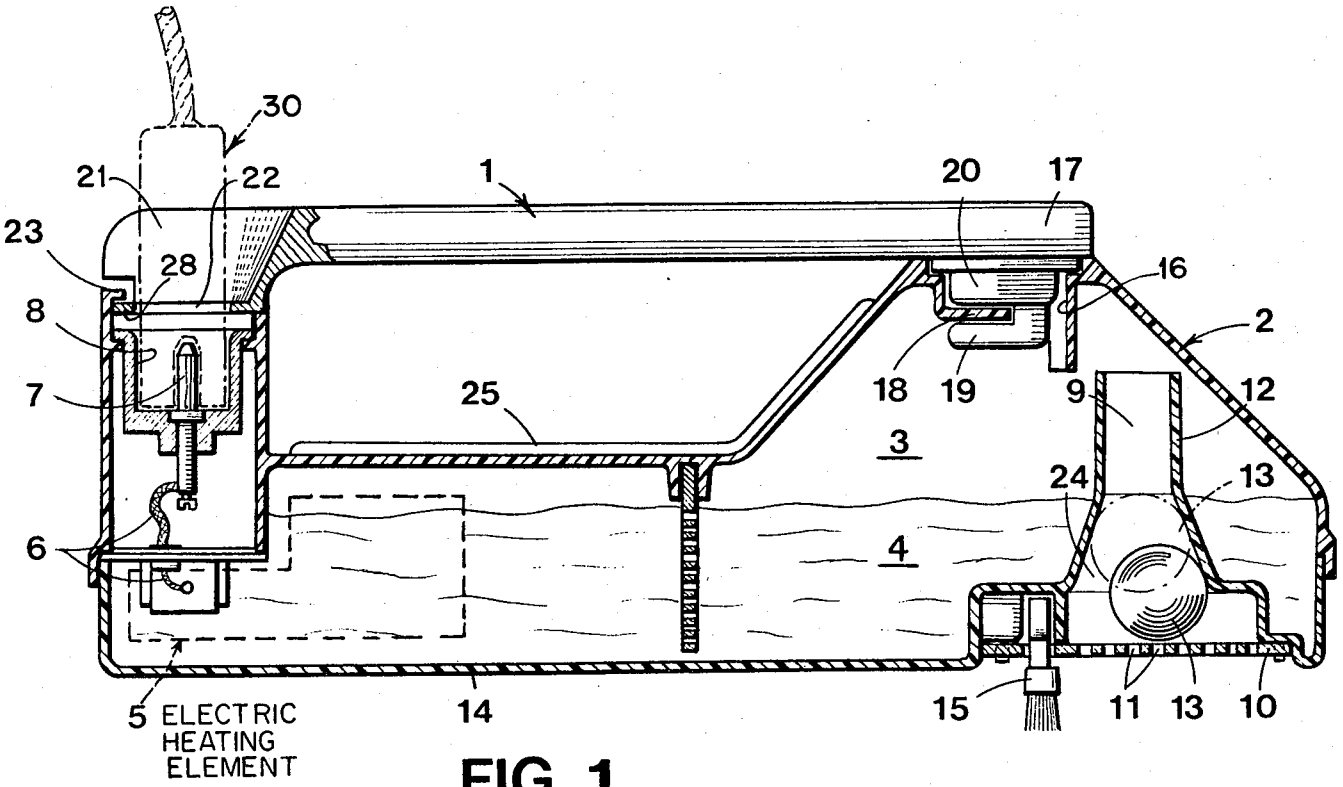
FIG. 1 is a vertical cross-section through the device with part of the handle and its stopper end being shown in elevation.
Figure 2:
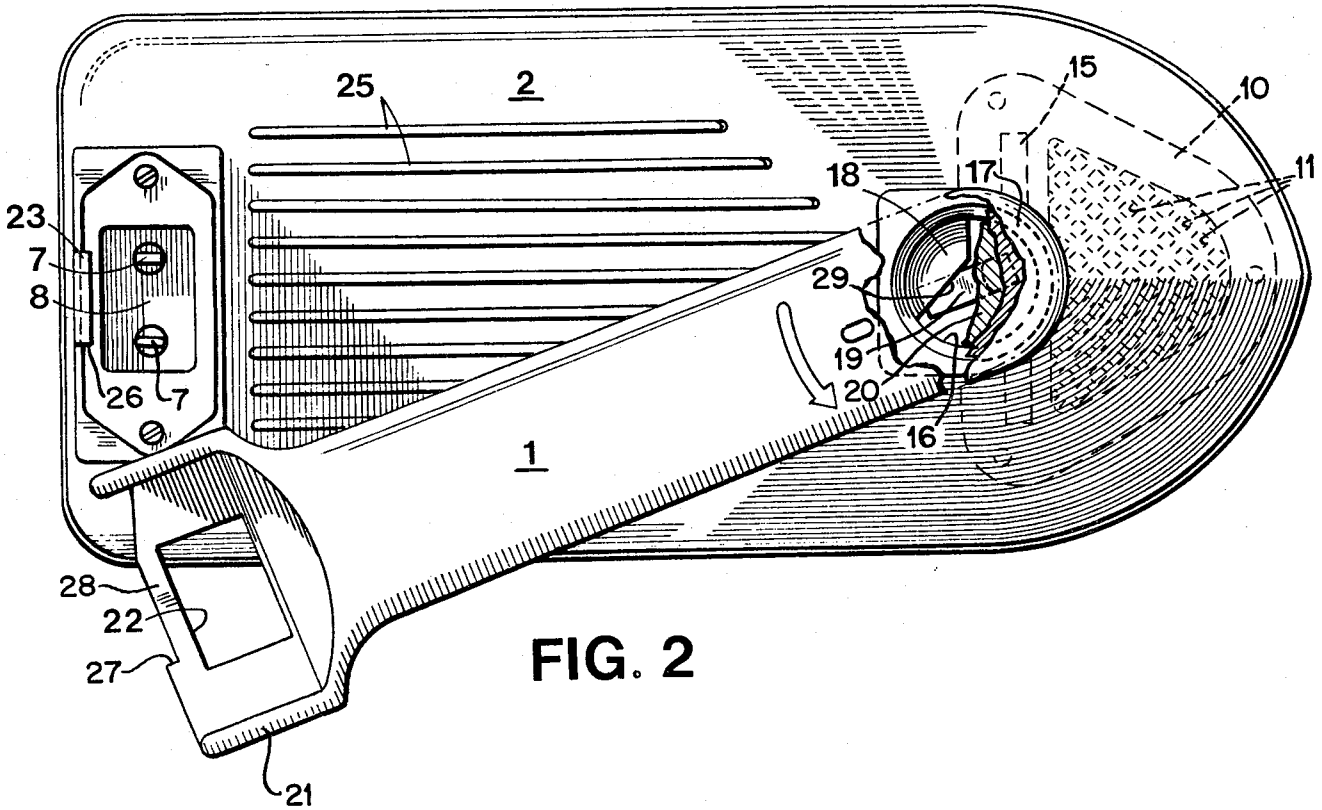
FIG. 2 is a plan view of the appliance with the stopper end of the handle broken away and with the handle in an intermediate position.

The appliance for removing creases in fabrics, as shown in FIG. 1 and 2, comprises a handle 1 and a body 2. The body forms a tank 3 containing water 4 which is heated by means of an electrical heating element 5 immersed therein and connected to an electrical current by means of lead wires 6 and contact prongs 7. The contact prongs 7 are seated in a socket 8 forming a socket which receives a female plug 30, shown in phantom lines in FIG. 1. When the handle 1 is attached to the device, it has an opening 22 therein which is in alignment with the socket 8 and through which the plug 30 extends.

The body 2 has a filling opening 16 communicating with the water tank 3. The filling opening 16 at its bottom has an inwardly projecting retaining flange 18, as shown in FIG. 2. As shown in FIG. 2, the retaining flange 18 occupies only a portion of the cross-sectional area of the filling opening 16. As shown in FIG. 1, the handle 1 on its end 17 has a stopper 20 that fits into and stoppers the filling opening 16. The stopper 20 is fixed with respect to the handle 1. Spaced below the bottom of the stopper 20 is a retaining finger 19 secured to or integral with the stopper 20, which retaining finger 19 when the handle is in its closed position extends below the retaining flange 18 in order to hold the handle in place. That is, to say, that the retaining flange 18 extends into the space between the stopper 20 and the retaining finger 19. When the handle is rotated in the direction of the arrow in FIG. 2, the retaining finger is rotated as well about the axis of the filling opening 16 to a point where the finger 19 will pass upwardly past the edge 29 of the retaining flange 18 due to the fact that the retaining flange 18 occupies only a portion of the bottom of the filling opening 16.

As mentioned, the end 21 of the handle 1, can be moved in the direction of the arrow as shown in FIG. 2 only if the plug 30 is removed from the socket 8 and the opening 22, thus at one and the same time freeing the handle 1 to be pivoted about its end 17 and simultaneously disconnecting the appliance from electricity.

On its end 21, the handle is positioned properly by means of a positioning and holding flange 23 which overlies a portion 28 of the handle, thus holding it down. The handle also has a stop 27 which cooperates with the edge 26 of the positioning flange 23 to insure that the handle is positioned with the opening 22 in proper alignment with the socket 8.

When in use, the water 4 is heated by the heating element 5 to create steam which passes through the duct 9 and then through the orifices 11 in a plate 10 to the outside. The duct 9 formed by the wall 12 widens toward the outlet in order to receive the plate 10 and form therewith a chamber 24 in communication with the tank 3 through the duct 9. When in the position shown in FIG. 1, which is the working position of the appliance, water 4 cannot enter the duct 9 or the chamber 24; however, steam generated by the water 4 can pass through the duct 9 and chamber 24 and thence through the orifices 11 to the fabric being worked upon. The plate 10 forms a prolongation of the face 14 of the body 2 of the appliance. A transverse brush 15 is located in this face 14 to aid in the removal of the creases from the fabric.

Housed within the chamber 24 is a ball 13 which, when the device is in use, rests upon the plate 10, as shown in FIG. 1. In this position of the ball 13, it presents little or no impediment to the passage of steam from the tank 3, through the duct 9, chamber 24 and orifices 11 to the fabric. However, if an attempt is made to fill the tank 3 through the openings 11 and duct 9 by turning the appliance over, then, in that event, the ball 13 moves to the position shown in phantom lines. When the ball is in the position shown in phantom lines, it closes the duct 9 and, as such, the appliance may not be filled through the orifices 11. Any water that is poured through them will accumulate in the chamber 24 between the plate 10 and the phantom line position of the ball, in which location it will immediately pour out through the orifices 11 when the device is again righted.

Cooling fins 25 have been incorporated in the upper surface of a body 2. These cooling fins 25 prevents the operator's hand from getting burned should it come into contact with that portion of the body 2 which underlies the handle 1.

From the above description, it will be apparent that the device cannot be filled when connected to the household current. In order to fill it in the normal way, the plug 30 must be removed and then the handle pivoted and removed as above described. Even attempts to fill the tank through the outlet orifices 11 are foiled by the ball check valve 13 as above described.

I claim:

1. In an appliance for removing creases from fabrics of the type having a body forming a water tank adapted to be partially filled with water and equipped with a handle for manipulating the housing during use to positions including a working position and an upside down position, a vapor outlet from the tank and an opening for filling the tank with water, electrical means on said body for heating and vaporizing contained water in the tank, a surface of said housing defining a plate having vapor outlet orifices communicating with said outlet for conducting the vapor thus produced onto the fabric from which the creases are to be removed when the plate is slid over the fabric with the housing in its working position, the improvement comprising an open-ended duct defining said vapor outlet, said duct extending upwardly from said plate and having an upper end communicating with a steam space above the level of the water in the tank when the appliance is in its working position and a lower end communicating with said orifices in said plate, a valve seat in the said duct and valve means positioned between the plate and the seat, said valve means being free to move in the duct under the force of gravity, whereby when the appliance is in its working position the valve means is spaced from the seat allowing steam to pass through the duct to said orifices and when the appliance is upside down the valve means engages the seat to prevent fluid flow in the duct in a direction from the plate toward the steam space.

2. The appliance according to claim 1 characterized in that the valve seat is conical and the valve means is a freely movable ball disposed in the conical seat when the appliance is turned upside down and remote from the seat which the appliance is in its working position.

3. In an appliance for removing creases from fabrics of the type having a body forming a water tank adapted to be partially filled with water and equipped with a handle for manipulating the housing during use to positions including a working position and an upside down position, a vapor outlet from the tank and opening for filling the tank with water, electrical means on said body for heating and vaporizing contained water in the tank, a surface of said housing defining a plate equipped with a transverse brush and vapor outlet orifices communicating with said outlet for the vapor thus produced onto the fabric from which the creases are to be removed when the plate is slid over the fabric with the housing in its working position, the handle having means for closing said filling opening of the tank, a first safety means preventing movement of the handle to open such closing means while the electrical means is connected to the appliance power source, the improvement comprising an open-ended duct extending upwardly from said plate and having an upper end communicating with a steam space above the level of the water in the tank when the appliance is in its working position and a lower end communicating with said orifices in said plate, a valve seat in the said duct and valve means freely movable in the duct under the force of gravity between the plate and the seat whereby when the appliance is in its working position the valve means is spaced from the seat allowing steam to pass through the duct to said orifices and when the appliance is upside down the valve means engages the seat to prevent fluid flow in the duct in a direction from the plate toward the stem space.

4. The appliance according to claim 3 characterized in that the valve seat is conical and the valve means is a freely movable ball disposed in the conical seat when the appliance is turned upside down and remote from the seat which the appliance is in its working position.

5. In an appliance for removing creases from fabrics of the type having a body forming a water tank adapted to be partially filled with water and equipped with a handle for manipulating the housing during use to positions including a working position and an upside down position, a vapor outlet from the tank and opening for filling the tank with water, electrical means on said body for heating and vaporizing contained water in the tank, a surface of said housing defining a plate equipped with a transverse brush and vapor outlet orifices communicating with said outlet for the vapor thus produced onto the fabric from which the creases are to be removed when the plate is slid over the fabric with the housing in its working position, the handle having means for closing said filling opening of the tank, a first safety means preventing movement of the handle to open such closing means while the electrical means is connected to the appliance power source, the improvement comprising an open-ended duct extending upwardly from said plate and having an upper end communicating with a steam space above the level of the water in the tank when the appliance is in its working position and a lower end communicating with said orifices in said plate, a conical seat in the said duct and a ball freely movable in the duct under gravity positioned between the plate and the seat whereby when the appliance is in its working position the ball is spaced from the seat allowing steam to pass through the duct to said orifices and when the appliance is upside down the ball engages the seat to prevent fluid flow in the duct in a direction from the plate toward the steam space.

* * * * *

UNITED STATES PATENT AND TRADEMARK OFFICE

CERTIFICATE OF CORRECTION

PATENT NO. : 4,366,367

DATED : December 28, 1982

INVENTOR(S) : Daniel Mazzucco

It is certified that error appears in the above-identified patent and that said Letters Patent is hereby corrected as shown below:

On the title page, Assignee should read

-- (73) Assignees: Terson and Marc Terraillon
Annemasse, France and Gaillard, France --.

Signed and Sealed this

*Fourteenth* Day of *February 1984*

[SEAL]

*Attest:*

GERALD J. MOSSINGHOFF

*Attesting Officer*

*Commissioner of Patents and Trademarks*